US005567089A

United States Patent [19]

Akamine

[11] Patent Number: 5,567,089

[45] Date of Patent: Oct. 22, 1996

[54] BLOCK FOR CONTSTRUCTING RETAINING WALL AND CONSTRUCTED RETAINING WALL STRUCTURE

[76] Inventor: Masumi Akamine, 7-61, Demachi, Kumamoto-shi, Kumamoto, Japan

[21] Appl. No.: 321,706

[22] Filed: Oct. 12, 1994

[30] Foreign Application Priority Data

Oct. 15, 1993 [JP] Japan ..... 5-281601
Dec. 16, 1993 [JP] Japan ..... 5-344434

[51] Int. Cl.[6] ..... E02D 29/02; E04C 1/00

[52] U.S. Cl. ..... 405/285; 52/606; 52/611; 405/284; 405/286

[58] Field of Search ..... 405/273, 284, 405/285, 286; 52/606, 611

[56] References Cited

U.S. PATENT DOCUMENTS

| | | | |
|---|---|---|---|
| 932,261 | 8/1909 | Flynn | 405/284 X |
| 4,426,176 | 1/1984 | Terada | 405/285 |
| 4,825,619 | 5/1989 | Forsberg | 405/286 |
| 4,957,395 | 9/1990 | Nelson | 405/285 X |
| 4,964,761 | 10/1990 | Rossi | 405/286 |
| 5,161,918 | 11/1992 | Hodel | 405/286 |

FOREIGN PATENT DOCUMENTS

| | | | |
|---|---|---|---|
| 2367147 | 6/1978 | France | 405/285 |
| 161230 | 10/1982 | Japan | 405/284 |
| 431 | 1/1984 | Japan | 405/284 |
| 185082 | 7/1994 | Japan | 405/284 |
| 1477814 | 5/1989 | U.S.S.R. | 405/284 |

*Primary Examiner*—John A. Ricci
*Attorney, Agent, or Firm*—Jordan and Hamburg

[57] ABSTRACT

A block for constructing a retaining wall comprises a front wall and a counterfort protruded from a back side of the front wall, wherein the counterfort is provided with a plurality of reinforcing steel bar insertion holes each of which has upper and lower ends thereof open-ended. Each reinforcing steel bar insertion hole disposed in a front wall side away from a neutral force plane is either a tapered hole increasing in diameter thereof from the upper opening to the lower opening thereof. Each reinforcing steel bar insertion hole disposed in a rear end side away from the neutral force plane is an inverse-tapered hole having a diameter increasing from the lower opening to the upper opening. The above-mentioned blocks for constructing the retaining wall are stacked on an upper surface of a footing foundation made of steel bar reinforced concrete, a plurality of anchoring steel bars protrudes from the footing foundation and a plurality of connecting steel bars is inserted into the steel bar insertion holes which are vertically aligned with each other and a filler is filled in the steel bar insertion holes to construct the retaining wall. Due to such a construction, the hardened filler is prevented from sliding relative to the steel bar insertion hole and the rigidity of the junctions where the abutting surfaces of the blocks for constructing retaining wall merge is increased to provide a rigid body integrally formed with the footing foundation.

6 Claims, 12 Drawing Sheets

BLOCK FOR CONTSTRUCTING RETAINING WALL AND CONSTRUCTED RETAINING WALL STRUCTURE

BACKGROUND OF INVENTION

This invention relates to blocks for constructing retaining wall and a constructed retaining wall structure.

Known retaining wall structures being constructed on the road or the seashore or the riverside include a retaining wall structure having the following construction. Namely, a plurality of T-shaped blocks for constructing retaining wall are stacked in several layers on a footing foundation embedded in the soil until the retaining structure having a desired height is obtained.

Each T-shaped block for constructing a retaining wall comprises a front wall and a counterfort, or buttress, which protrudes rearwardly from the back surface of the front wall. A plurality of holes for inserting reinforcing steel bar are formed in the counterfort. The counterforts of respective layers are overlapped with each other in a vertical direction so as to make their respective holes for inserting reinforcing steel bar align with each other and a plurality of anchoring steel bars which protrude front the footing foundation are inserted into the holes for reinforcing steel bar insertion. At the intermediate or upper portion of the retaining wall structure, a plurality of connecting reinforcing steel bars, which are connected with the anchoring reinforcing steel bars, are inserted in the holes for reinforcing steel bar insertion. Simultaneously the filler, such as cement mortar or concrete, is filled in the holes for inserting reinforcing steel bar to integrally connect a plurality of the blocks for constructing the retaining wall in a vertically stacked manner to construct a retaining wall structure of a desired height.

However, since the soil pressure which acts on the retaining wall structure increases proportionally from the upper portion to the lower portion, the block for constructing the lowermost region of the retaining wall structure must be large in size and have a shape with an excellent section modulus. In the existing retaining wall structure, when the large-sized blocks are piled up or stacked, each block suffers from poor section modulus because of the problems inherent in the holes for reinforcing steel bar insertion formed in each block. Accordingly, the maximum height of the retaining wall structure is less than approximately 10 m so that a retaining wall structure having a height greater than 10 m cannot be constructed.

Furthermore, the above-mentioned holes for reinforcing steel bar insertion are not formed in such a manner that they prevent sliding movement of the filler, such as cement mortar, relative to the steel bar, wherein such sliding movement is caused by contraction or shrinkage of the filler which takes place after being filled in the holes for reinforcing steel bar insertion. Accordingly, when an outer force acts on the blocks for constructing the retaining wall which are stacked or piled up vertically, the cement mortar which is hardened or solidified in the holes for reinforcing steel bar insertion slide within the holes so the retaining wall structure does not have sufficient rigidity.

Still furthermore, at the junctions or connecting portions, where the blocks for constructing the retaining wall which are stacked vertically are connected with each other, if the reinforcing steel bars which are inserted in the holes for reinforcing steel bar insertion are offset from the predetermined insertion position, the covering layer of the cement mortar or the concrete which fills the holes for reinforcing steel bar insertion becomes thin so that the adhering strength of the hardened filler to the blocks is deteriorated or weakened. Thus, the junctions or connecting portions are also deteriorated making the constructed retaining wall structure unstable.

Accordingly, it is an object of the present invention to solve above-mentioned conventional problems and to provide blocks for constructing retaining walls and a retaining wall structure, wherein the retaining wall has a height greater than the maximum height of the conventional retaining wall structure while satisfying the various structural objectives including excellent section modulus, and prevention of sliding movement of the filler, such as cement mortar or concrete, hardened or solidified in the holes for reinforcing steel bar insertion, thus assuring a sufficiently thick covering layer of filler even at the junctions or connecting portions so that the blocks are integrally connected with the foundation to provide the retaining wall structure.

SUMMARY OF INVENTION

For achieving the above object, the present invention provides a block for constructing a retaining wall A, wherein the block A comprises a front wall 14 and a counterfort 16 protruding from a back side of the front wall 14. The counterfort 16 is divided mainly by a plurality of partition walls 21 to form a plurality of reinforcing steel bar insertion holes 22 therein, each of which has upper and lower ends thereof open-ended. Each reinforcing steel bar insertion hole 22 disposed in a front wall 14 side of a position assumed to be a neutral plane N—N of the block A is either a tapered hole 26, increasing in diameter from an upper opening to a lower opening thereof or a straight hole having a uniform diameter throughout the entire length thereof. Additionally, each reinforcing steel bar insertion hole 22 disposed in a rear end side of the neutral plane N—N is an inverse-tapered hole increasing in diameter from the lower opening to the upper opening.

Each reinforcing steel bar insertion hole 22 formed in the counterfort 16 is optionally provided with a trumpet-shaped tapered face 28 at the upper and the lower ends thereof.

The invention also provides a retaining wall structure 10, wherein the retaining wall structure 10 comprises a plurality of blocks A for constructing the retaining wall, and each block A comprises a front wall 14 and a counterfort 16 protruding from a back side of the front wall 14. The counterfort 16 is divided mainly by a plurality of partition walls 21 to form a plurality of reinforcing steel bar insertion holes 22 therein, each of which has upper and lower ends thereof open-ended. Each reinforcing steel bar insertion hole 22 disposed in a front wall 14 side of a position assumed to be a neutral face N—N of a bending stress caused by an outer force acting on the block A in a direction toward the front wall 14 side from a rear sustaining wall side is either a tapered hole 26 increasing in diameter from an upper opening to a lower opening thereof or a straight hole having a uniform diameter throughout the entire length thereof. Additionally each reinforcing steel bar insertion hole 22 disposed in a rear end side from the neutral plane N—N is an inverse-tapered hole increasing a diameter from a lower opening to an upper opening. The blocks A for constructing the retaining wall are stacked on an upper surface of a steel bar reinforced concrete footing foundation 12 in such a manner that each reinforcing steel bar insertion hole 22 is vertically aligned with the reinforcing steel bar insertion hole 22 in upper and lower layers, and a plurality of anchoring steel bars 18 protruding from the footing foundation 12 and a plurality of connecting steel bars 20, used for connecting blocks A mounted on the footing foundation 12, are connected by the reinforcing steel bar insertion holes 22 and a filler M filled in the reinforcing steel bar insertion holes 22 to integrally connect the blocks A for constructing the retaining wall with each other.

The blocks A for constructing the retaining wall include a plurality of kinds of blocks which are different in length of the counterfort 16. Blocks A1 for constructing the retaining wall have the greatest counterfort length and are stacked on the upper surface of the steel bar reinforced concrete footing foundation 12. Blocks A2, A3, A4 for constructing the retaining wall have a shorter counterfort length and are sequentially stacked to form a retaining wall structure having a stepped ladder shape as viewed from the rear.

The footing foundation 12 comprises a front foot portion 32, a rear foot portion 34 connected to a rear end of the front foot portion 32 having a slope face inclined downwardly from a front portion thereof to a rear portion thereof, and a slippage preventing protrusion 36 formed on a bottom surface of the foundation 12. The front foot portion 32 forms a stepped down foundation 38 at a toe portion, and the blocks A for constructing the retaining wall are stacked on the slope face of the rear foot portion in such a manner that the blocks for constructing the retaining wall are stacked in an embankment gradient which is similar to a gradient of a cut slope of a retaining wall construction site, and a back-filling concrete 40 is filled in back of the blocks A for constructing the retaining wall stacked in the above manner from the upper portion of a heel plate of the rear foot portion 34.

With the blocks for constructing the retaining wall and the constructed retaining wall structure according to the present invention, a plurality of large-sized blocks for constructing the retaining wall are stacked on the upper surface of the footing foundation made of steel bar reinforced concrete, then the anchoring reinforcing steel bars and connecting reinforcing steel bars are inserted in respective aligned holes for reinforcing steel bar insertion. The filler is filled in and hardened in the holes for reinforcing steel bar insertion to construct a lower portion of the retaining wall structure. On an upper surface of the lower portion of the retaining wall structure, a plurality of secondary large-sized blocks for constructing the retaining wall are stacked in the same manner to construct an intermediate portion of the retaining wall. Furthermore, on an upper surface of the intermediate portion of the retaining wall structure, a plurality of intermediate-sized blocks for constructing the retaining wall are stacked in the same manner to construct an upper portion of the retaining wall. Still furthermore, on an upper surface of the upper portion of the retaining wall structure, a plurality of small-sized blocks for constructing the retaining wall are stacked in the same manner to construct an uppermost portion of the retaining wall.

In the constructed retaining wall structure, at the front-wall side of the retaining wall, the filler is filled and hardened in respective holes, each of which has the diameter becoming greater downwardly in a tapered manner, so as to form a plurality of elongated frustconically shaped struts which are, in turn, integrally connected with each other to form a steel bar reinforced pillar which is integrally connected with the footing foundation. Meanwhile, at the base portions of the counterforts of the blocks which abut with the back surface of the front walls, the filler is filled and hardened in respective holes, each of which has the diameter becoming greater upwardly in a tapered manner, so as to form a plurality of elongated inversely-frustconically shaped struts which are, in turn, integrally connected with each other to form a steel bar reinforced pillar which is integrally connected with the footing foundation.

Due to such a construction, even when a large soil pressure acts on the rear sustaining side of the retaining wall structure and eventually a compression force is exerted downwardly on the front wall side of the retaining wall while a tensile force is upwardly exerted on the rear end portion of the counterfort, the slide movement of the steel bar reinforced concrete pillar formed in the rear retaining wall is prevented and the retaining wall structure forms an integral rigid body which withstands the compression force and the tensile force thus enabling the construction of the retaining wall having a height greater than the maximum height of the conventional retaining wall.

PREFERRED EMBODIMENTS OF THIS INVENTION

The preferred embodiments of the present invention are explained in conjunction with attached drawings.

Figure 1:
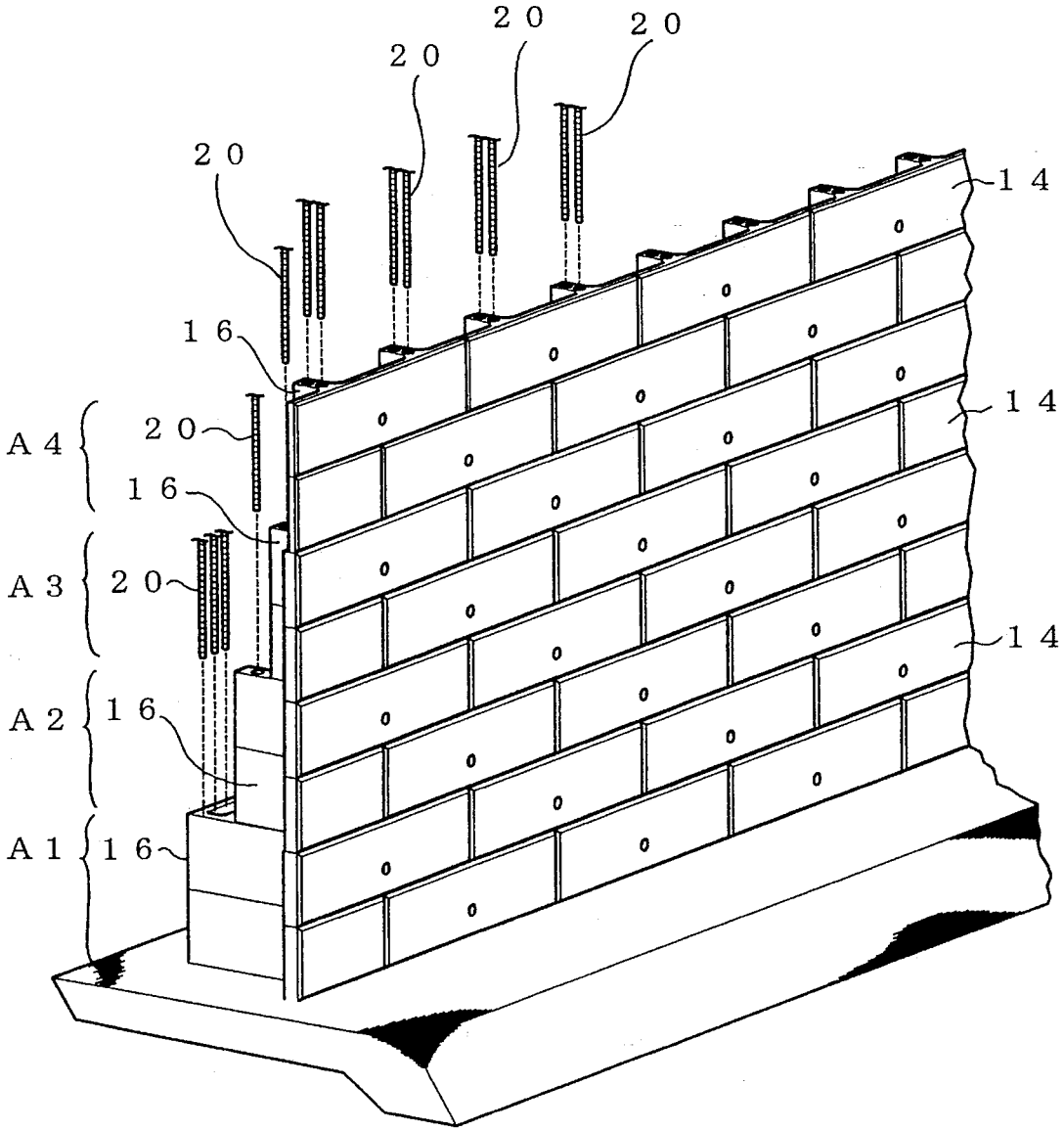
FIG. 1 is a perspective view of a retaining wall structure according to an embodiment of this invention.
Figure 2:
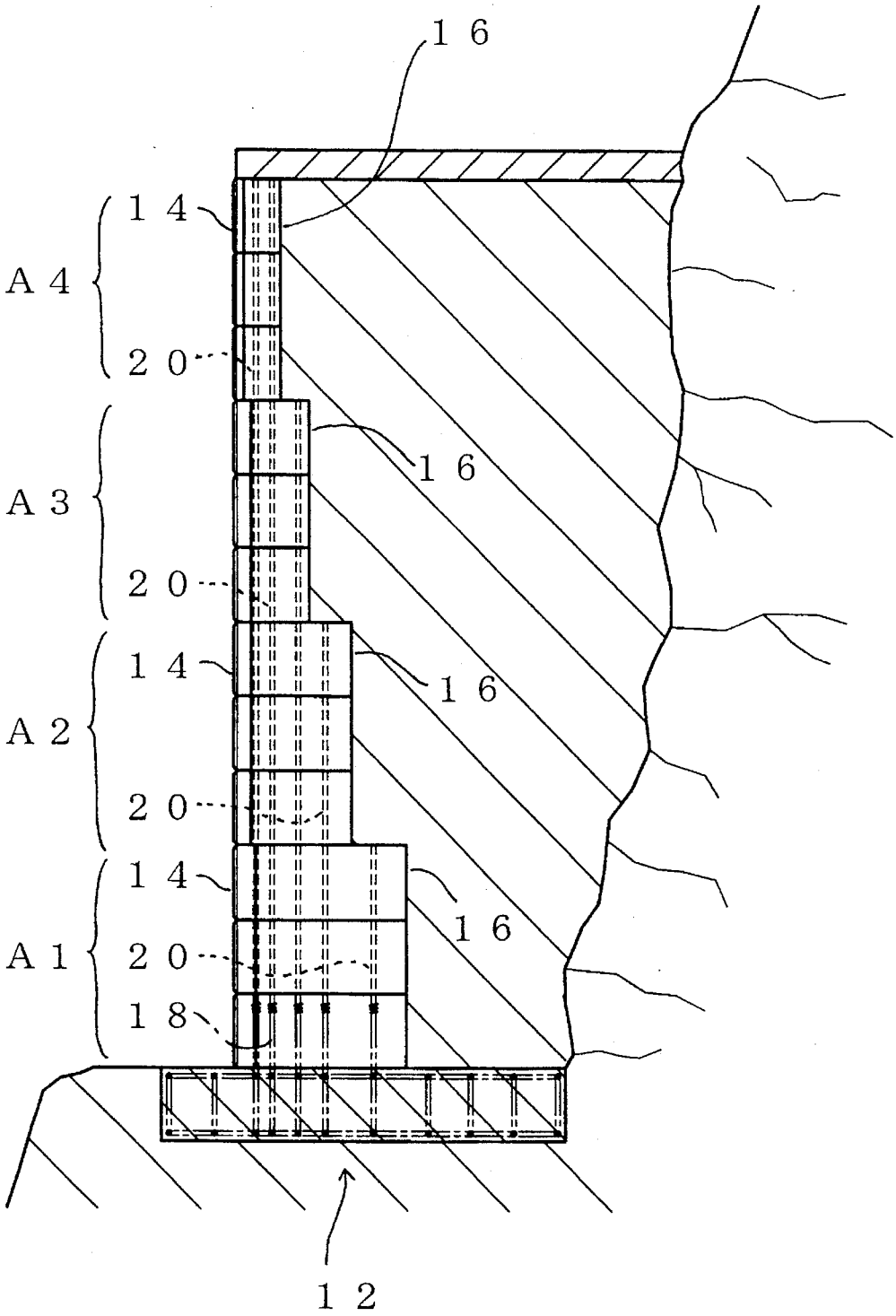
FIG. 2 is a longitudinal cross sectional view of the retaining wall structure.

In FIG. 1 and FIG. 2, a retaining wall 10 constructed by a plurality of block A for constructing a retaining wall according to the embodiment of the invention (constructed retaining wall structure) is shown.

As can be understood from the drawings, in the retaining wall 10, a plurality of large-sized blocks A1 for constructing retaining wall are stacked on a footing foundation 12 made of steel bar reinforced concrete in three layers to form a lower layer portion of the retaining wall 10. Each of the large-sized blocks A1 for constructing the retaining wall is, as explained later, provided with a front wall 14 and a counterfort 16 which protrudes from a back surface of the front wall 14.

Furthermore, on an upper surface of the large-sized blocks A1 for constructing the retaining wall, a plurality of secondary large-sized blocks A2, each of which has the counterfort 16 a length shorter than that of the large-sized blocks A1 as explained later, are mounted m three layers to form an intermediate layer portion of the retaining wall 10.

Furthermore, on an upper surface of the secondary large-sized blocks A2 for constructing retaining wall, a plurality of middle-sized blocks A3, each of which has the counterfort 16 a length shorter than that of the secondary large-sized blocks A2, as explained later, are mounted in three layers so as to form an upper layer portion of the retaining wall 10.

Still furthermore, on an upper surface of the upper layer portion, a plurality of small-sized blocks A4, each of which has the counterfort 16 a length shorter than that of the middle-sized blocks A3, as explained later, are mounted in three layers to form an uppermost layer portion of the retaining wall 10.

The footing foundation 12 made of steel bar reinforced concrete and the large-sized blocks A1 for constructing the retaining wall are integrally connected with each other by means of a plurality of anchoring steel bars 18 which protrude from the footing foundation 12 made of steel bar reinforce concrete. Meanwhile, the large-sized blocks A1 for constructing the retaining wall, the secondary large-sized blocks A2 for constructing the retaining wall, the middle-sized blocks A3 for constructing the retaining wall and the small-sized blocks A4 for constructing the retaining wall are integrally connected with each other. In this manner, with respect to the retaining wall 10 according to this embodiment, all blocks A for constructing the retaining wall are integrally connected with the footing foundation 12 made by steel bar reinforced concrete with the connecting steel bars 20 whereby the retaining wall 10 becomes a rigid body having high strength and resistance to the soil pressure acting on the back surface of the retaining wall 10.

The number of layers of stacked blocks A for constructing retaining wall is not limited to the above embodiment and the blocks A for constructing the retaining wall are stackable in a desired number of layers to construct the retaining wall 10 of a desired height.

The block A for constructing walls according to the invention include concrete blocks molded without arranging steel bars into the front wall 14 and the counterfort 16 as well as the steel bar reinforced concrete blocks molded while arranging main bars and distribution bars in the front wall 14 and the counterfort 16. Especially when the constructed retaining wall structure 10 is constructed by blocks A for constructing the retaining wall molded while arranging mains bars and distribution bars in the blocks, the retaining wall 10 has excellent strength and section modulus.

In FIG. 3 to FIG. 11, the blocks A for constructing the retaining wall according to an embodiment of the invention are shown.

As can be understood from these drawings, the block A for constructing retaining wall is made of steel bar reinforced concrete and comprises a front wall 14, formed in an elongated rectangular shape, and a pair of counterforts 16,16, protruding from the back surface of the front wall 14 at positions adjacent to both lateral ends of the front wall 14.

Each counterfort 16 is divided by a plurality of partitions 21 into a plurality of reinforcing steel bar insertion holes 22 arranged in a rear sustaining wall protruding direction, wherein each reinforcing steel bar insertion hole 22 has upper and lower ends thereof open-ended.

In the drawings, each counterfort 16 is provided with two or three holes 22, for inserting reinforcing steel bars, having a rectangular planar shape with the size of openings of the holes 22 becoming narrower as the length of the counterfort 16 of the respective blocks A for constructing a rear wall becomes shorter. The planar shape of the holes 22 for reinforcing steel bar insertion may not necessarily be limited to the above-mentioned shape and includes a circular shape, an elliptical shape, a polygonal shape. Although the holes 22 for steel bar insertion are formed by dividing the counterfort 16 by means of a plurality of partition walls 21, others may be used in lieu of these partition walls 21.

In the holes 22 for reinforcing steel bar insertion, the anchoring steel bars 18 and the connecting steel bars 20 connected to the anchoring steel bars 18 are inserted and then a filler such as cement mortar or concrete is filled in the holes 22.

As shown in the drawings, among all steel bar insertion holes 22, each reinforcing steel bar insertion hole 22, disposed in a front wall 14 side of a position assumed to be a neutral plane N—N of a bending stress caused by an outer force acting on the block in a direction toward the front wall 14 from the counterfort 16, is formed as a tapered hole 24 increasing in diameter from an upper opening to a lower opening thereof, while each reinforcing steel bar inserting hole disposed in a rear end side of the neutral plane is made of an inverse-tapered hole 26 having a diameter that becomes greater from a lower opening to an upper opening.

The retaining wall having the above-mentioned structure is a kind of T-shaped beam. In this case, however, since the stress on steel bars arranged at the position closest to the front wall 14 can be ignored, the retaining wall can be treated as a simple steel bar reinforced T-shaped beam.

Figure 15:
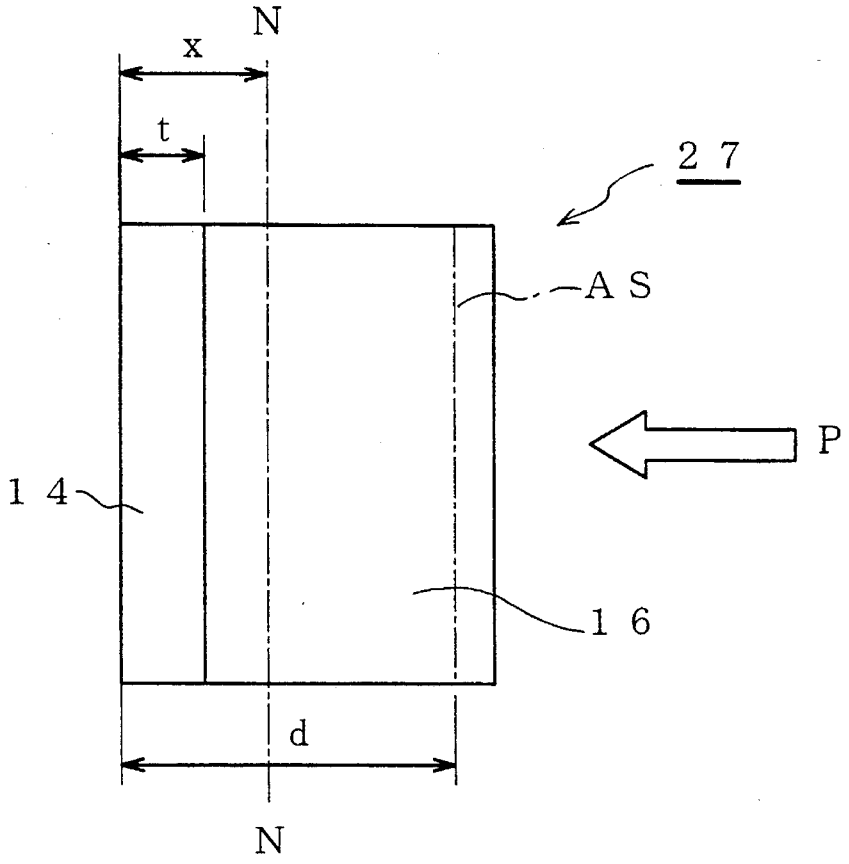
FIG. 15 is a side view showing a neutral plane against the bending stress of the solid steel bar reinforced T-shaped beam.

Accordingly, as shown in FIG. 15, when an outer force P, such as soft pressure, is exerted in a direction from the rear end side of the counterfort 16 to the front wall 14, the bending stress which arises in relation to the distance X from the compression brim (brim of the front face side) to the neutral plane N—N can be expressed by the following formula 1.

$$X=(ndAS+bt2/2)/(nAS+bt) \quad \text{(Formula 1)}$$

wherein, in the above formula n=ratio between modulus of elasticity of concrete and steel (such as iron steel)

n=ES/EC

ES=modulus of elasticity of steel

EC=modulus of elasticity of concrete

AS=total cross sectional area of tensile steel bar (anchoring steel bar and connecting steel bar)

b=width of front wall t=thickness of front wall d=distance from the from surface of from wall to the center of tensile steel bar The position of the neutral plane N—N, calculated by the above-mentioned formula 1, is located approximately close to the from wall 14.

However, in case the counterfort 16 is considerably long and the total cross sectional area AS thereof is considerably large, such a neutral plane N—N calculated by the above-mentioned formula 1 is located close to the middle of the protruding length of the counterfort 16. When the protruding length of the counterfort 16 is short, the distance X from the compression brim (brim of the front face side) to the neutral plane N—N can be X <t and is located in the front wall 14.

Figure 16:
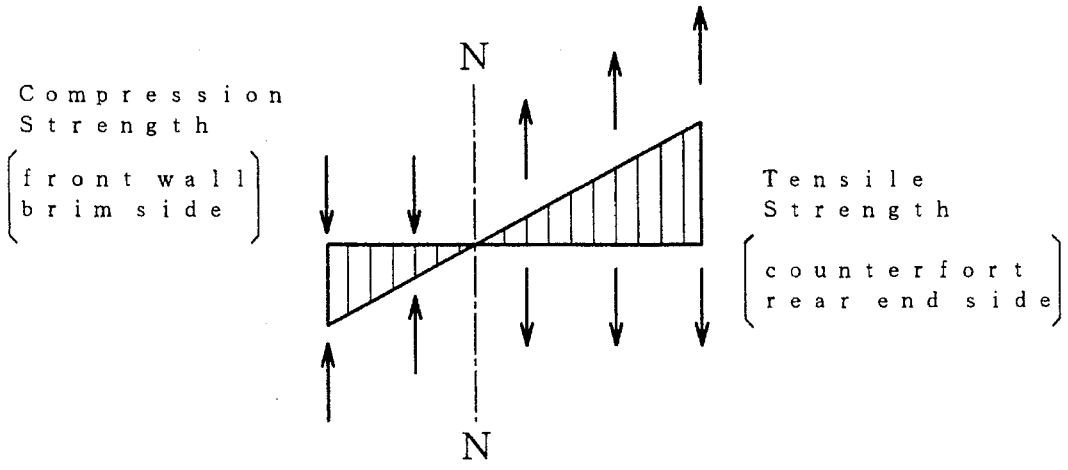
FIG. 16 is a stress diagram of the bending stress of the solid steel bar reinforced T-shaped beam shown in FIG. 15.

As shown in FIG. 15, when the simple steel bar reinforced T-shaped beam 27 receives a normal bending stress due to a pressing force P, a compression force is exerted on the front wall side portion of the simple steel bar reinforced T-shaped beam 27 from the neutral plane N—N which works as a center while a tensile force is exerted on the protruding end side of the simple steel bar reinforced T-shaped beam 27 as shown in the stress diagram of FIG. 16.

Accordingly, if the block A for constructing retaining wall is assumed to be the above-mentioned simple steel bar reinforced T-shaped beam 27, when a pressing force P is exerted on the block A for constructing the retaining wall due to the soil pressure acting on the back surface side of the block A, among a plurality of reinforcing steel bar insertion holes 22, tapered holes 24, disposed on the front wall 14 side, having the diameter increasing downwardly, receive the compressive force while tapered holes 26, disposed on the protruding end side of the counterfort 16, have the diameter increasing upwardly and receive the tensile force.

Figure 17:
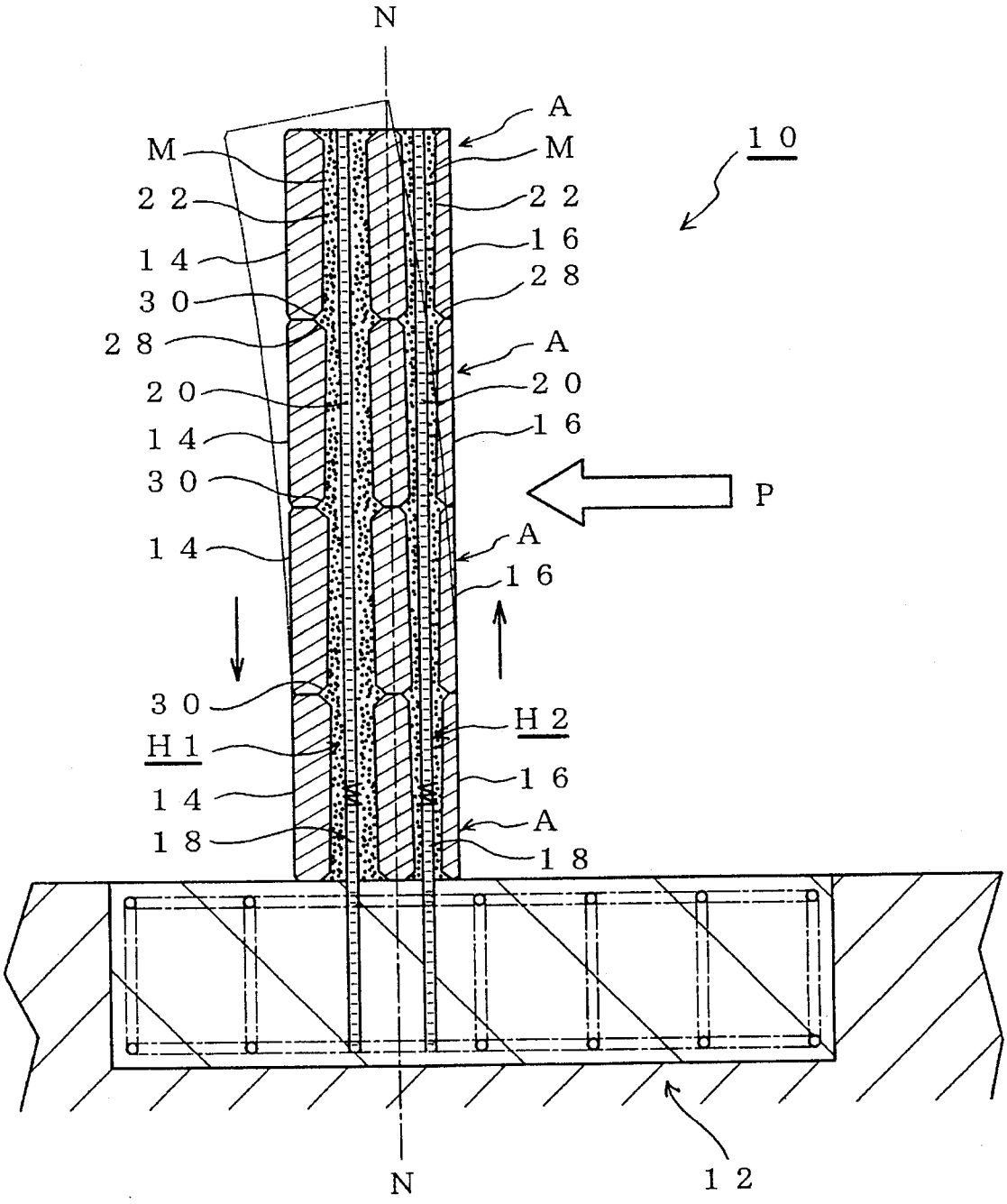
FIG. 17 is an enlarged longitudinal cross sectional view showing the steel bar insertion holes in the retaining wall constructed by blocks for constructing the retaining wall.

As shown in FIG. 17, the blocks A for constructing the retaining wall according to the invention are stacked on the upper surface of the footing foundation 12 made of steel bar reinforced concrete in several layers. In the reinforcing steel bar insertion holes 22 which are vertically aligned, the anchoring steel bars 18 which protrude upwardly from the footing foundation 12 made of steel bar reinforced concrete and the connecting steel bars 20 which are connected to the anchoring steel bars 18 are inserted. Subsequently, the filler M, such as cement mortar or concrete, is filled in the reinforcing steel bar insertion holes 22 and solidified to construct the retaining wall 10.

In the constructed retaining wall structure 10, at the front-wall 14 side of the neutral plane N—N of the respective block A for constructing the retaining wall, the filler M is filled and hardened in respective holes 22, each of which is made of a downwardly widened tapered hole 24, to form a steel bar reinforced pillar H1 made of a plurality of elongated frustconically shaped struts integrally connected with the footing foundation 12.

Meanwhile, at the end portions of the counterforts 16 of the blocks from the neutral plane N—N, the filler M is led and hardened in respective holes 22, each of which is formed as an upwardly widened tapered hole 26, to form a steel bar reinforced concrete pillar H2 made of a plurality of elongated inverseley-frustconically shaped struts integrally connected with the footing foundation 12.

Due to such a construction, in the case where a large soil pressure P acts on the counterfort 16 side of the retaining wall structure 10 in the arrow direction gives rise to a bending moment, a compression force is exerted downwardly on the front wall 14 side of the retaining wall 10, wherein the steel bar reinforced pillar H1, made of a plurality of elongated frustconically shaped struts, resists the compressive force by having the friction resistance of the steel bar reinforced pillar H1 relative to the steel bar insertion holes increased to prevent relative sliding movement between them, whereby the retaining wall can withstand the compressive force and prevent the rupture thereof.

Furthermore, in the above condition where the soil pressure P acts on the retaining structure 10, although the tensile force is exerted upwardly on the protruding end of the counterfort 16, the steel bar reinforced concrete pillar H2, made of a plurality of elongated inversely-frustconically shaped struts, resists the tensile force by having the friction resistance of the steel bar reinforced pillar H2 relative to the steel bar insertion holes 26 increased, preventing relative sliding movement between them, whereby the retaining wall 10 can withstand the tensile force and can sufficiently meet the requirements necessary for a rigid body.

Furthermore, as shown in FIG. 3 to FIG. 11, each reinforcing steel bar insertion hole 22 formed in the counterfort 16 is provided with trumpet-shaped tapered faces 28,28 at the upper and lower ends thereof.

Due to such a construction, as shown in FIG. 17, on the abutting faces of the vertically stacked blocks A for constructing the retaining wall, the trumpet-shaped faces 28,28 formed on the lower end of the steel bar reinforcing holes 22 of one block A for constructing retaining wall are snugly merged with the trumpet-shaped faces 28,28 formed on the bottom end of the steel bar reinforcing holes 22 of the adjacent block A for constructing the retaining wall, and the filler M is hardened in a space formed by merged upper and lower trumpet-shaped faces 28,28 to form a peripheral protrusion 30 having a diamond-shaped cross section.

Due to such a construction, the steel bar reinforced pillars H1, H2 formed in the aligned steel bar insertion holes 22 prevent the sliding movement relative to the blocks A for constructing the retaining wall. Furthermore, the amount of the filler M led in the steel bar connecting portions within the steel bar insertion holes 22 is increased to provide a desired amount of covering on the anchoring steel bar 18 and the connecting steel bars 22 to reinforce the strength of the constructed retaining wall structure.

The block A for constructing the retaining wall explained above in view of drawings, is provided with a single downwardly widened tapered hole 24 at the front wall side thereof and, in the case where the length of the counterfort 16 is long, the neutral plane N—N is shifted to the middle portion side of the counterfort 16. In this case, the rear portion of the downwardly widened tapered hole 24 is widened and the diameter of the neighboring tapered hole is narrowed.

The blocks A for constructing the retaining wall are not limited to the large-sized blocks for constructing the retaining wall which are described in the previously mentioned embodiment, but include the middle-sized or small-sized blocks for constructing the retaining wall which are stacked on the large-sized blocks so long as these blocks have the same remarkable function and effect.

Subsequently, the constructed retaining wall structure 10 according to this embodiment is explained hereinafter.

As shown in FIG. 1 and FIG. 2, for constructing the retaining wall 10, firstly, a plurality of large-sized blocks A1 for constructing the retaining wall, each of which comprises the front wall 14 and the counterfort 16 protruding from the back surface of the front wall 14, are stacked on the footing foundation 12 made of steel bar reinforced concrete in approximately three layers (number of layers being not limited) to form the lower layer portion of the retaining wall 10.

On the upper surface of the stacked large-sized blocks A1 for constructing the retaining wall, a plurality of secondary large-sized blocks A2, a plurality of middle-sized blocks A3, a plurality of small-sized blocks A4 which have the counterfort 16 of a lengthy sequentially shorter than that of the preceding blocks, are respectively mounted in a plurality of layers to construct the retaining wall 10.

Figure 3:
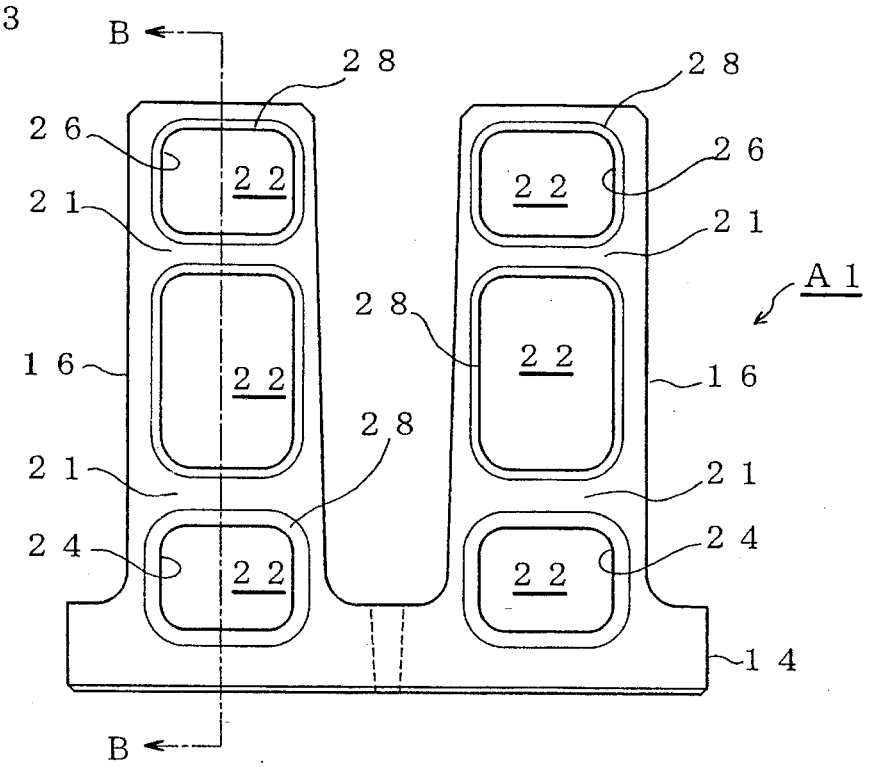
FIG. 3 is a plan view of a large-sized block for constructing the retaining wall.
Figure 4:
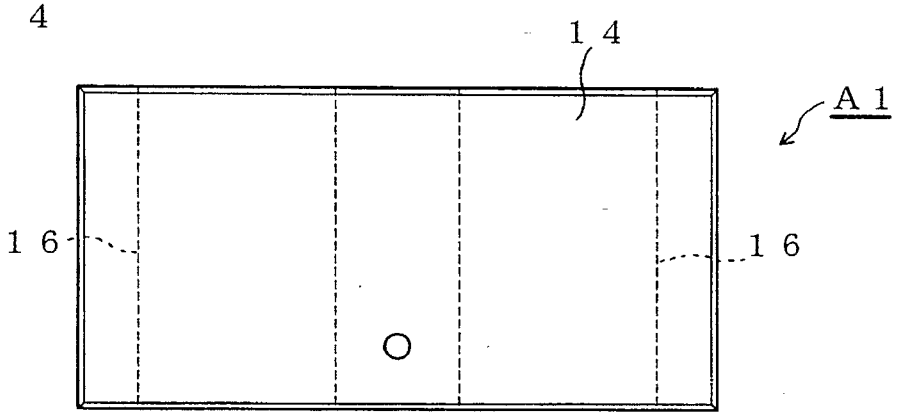
FIG. 4 is an elevational view of the large-sized block for constructing the retaining wall.
Figure 5:
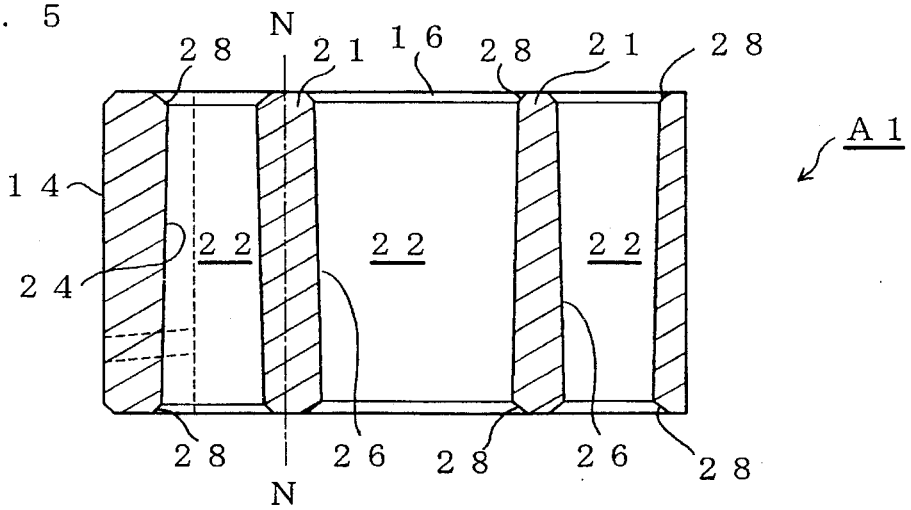
FIG. 5 is a cross sectional view of the large-sized block for constructing the retaining wall taken along the line B—B of FIG. 3.

In FIG. 3 to FIG. 5, the large-sized blocks A1 for constructing the lower layers of the constructed retaining wall structure 10 are shown.

Each of the large-sized blocks A1 comprises the laterally elongated front wall 14, a pair of counterforts 16, 16 which protrude from the back surface of the front wall at positions adjacent to both lateral ends of the front wall 14, and each counterfort 16 is provided with three steel bar insertion holes 22 arranged in a counterfort protruding direction having both upper and lower ends open-ended and a rectangular planar shape.

As shown in FIG. 5, among these three steel bar insertion holes 22, the hole 22 which is disposed most closely to the front wall 14 and furthest from the neutral plane N—N of the block A for constructing the retaining wall is the downwardly widened tapered hole 24 having an increasing diameter from the upper end to the lower end, while two holes 22 disposed at the intermediate or end position, located in the protruding end side of the counterfort 16 from the above-mentioned neutral plane N—N, are formed as the upwardly widened tapered holes 26 increasing diameter from the bottom end to the upper end.

Furthermore, the trumpet-shaped enlarged tapered faces 28,28 are formed in the upper and lower ends of the above-mentioned steel bar insertion holes 22.

The above-mentioned large-sized blocks A 1 for constructing the retaining wall are stacked in a plurality of layers on the footing foundation 12 made of steel bar reinforced concrete, the anchoring steel bars 18 which protrude upwardly from the footing foundation 12 are inserted in the vertically aligned reinforcing steel bar insertion holes 22, the connecting steel bars 20 are connected to the anchoring steel bars 18, and the filler M, such as the cement mortar or concrete, is led and solidified in the aligned steel bar insertion holes 22.

Figure 6:
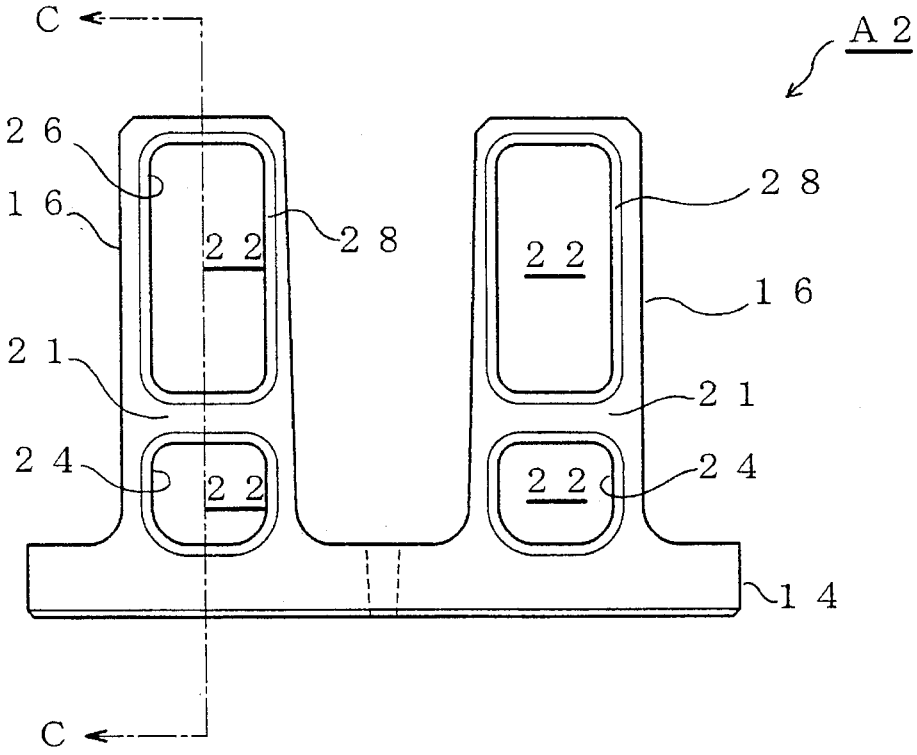
FIG. 6 is a plan view of a secondary large-sized block for constructing the retaining wall.
Figure 7:
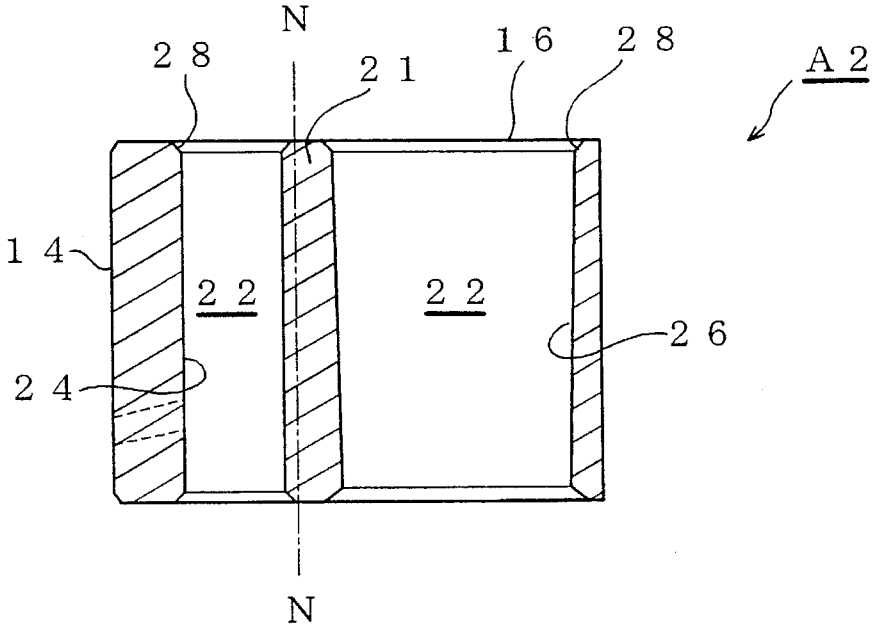
FIG. 7 is a cross sectional view of the secondary large-sized block for constructing the retaining wall taken along the line C—C of FIG. 6.

In FIG. 6 and FIG. 7, the secondary large-sized blocks A2 which are stacked on the upper surface of the above-mentioned large-sized blocks A1 for constructing the intermediate layers of the constructed retaining wall structure 10 are shown.

The secondary large-sized block A2 comprises the laterally elongated front wall 14, a pair of counterforts 16,16, which protrude from the back surface of the front wall at positions adjacent to both lateral ends of the front wall 14. Each counterfort 16 has a length shorter than that of the counterfort 16 of the large-sized block A1 and is provided with two steel bar insertion holes 22 which have a planar rectangular shape and are arranged in a rear sustaining wall protruding direction.

As shown in FIG. 7, one steel bar insertion hole 22 is disposed close to the from wall 14 offset from the neutral plane N—N of the block A for constructing the retaining wall and is formed having a downwardly widened tapered hole 24 with an increasing diameter from the upper end to the lower end, while the other hole 22 is formed as an upwardly widened tapered hole 26.

Furthermore, the trumpet-shaped enlarged tapered faces 28,28 are formed in the upper and lower ends of the above-mentioned steel bar insertion holes 22.

Figure 14:
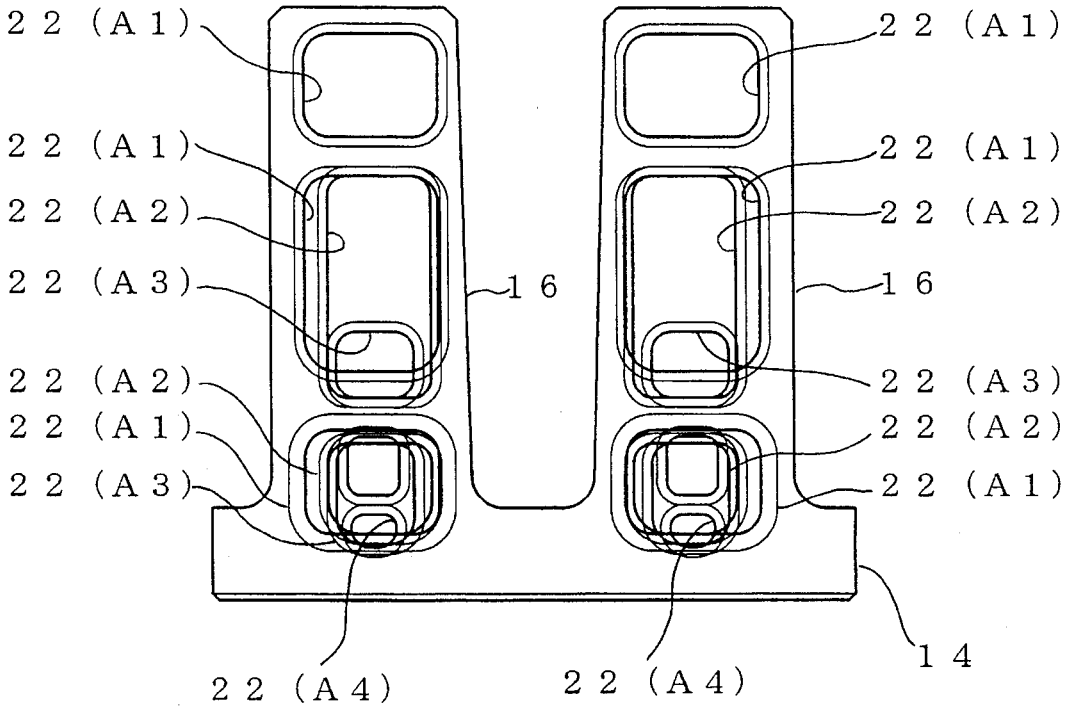
FIG. 14 is an explanatory view showing junctions of the steel bar insertion holes of the respective blocks for constructing the retaining wall which are stacked vertically.

As shown in FIG. 14, two steel bar insertion holes 22 (A2) formed in the above-mentioned secondary large-sized blocks A2 for constructing the retaining wall are arranged to be aligned with steel bar insertion holes 22 (A1) formed in the front wall 14 side and the intermediate side of the counterfort 16.

The above-mentioned secondary large-sized blocks A2 for constructing the retaining wall are stacked on the above-mentioned large-sized blocks A1, and within the steel bar insertion holes 22 of the secondary large-sized blocks A2 for constructing the retaining wall, the connecting steel bars 20 protruding from the steel bar insertion holes 22 of the above-mentioned large-sized blocks A1 for constructing the retaining wall are connected with succeeding connecting steel bars 20 and the filler M is filled and solidified.

Accordingly, the secondary large-sized blocks A2 for constructing the retaining wall are firmly connected with the large-sized blocks A1 for constructing the retaining wall. In the above condition, when the soil pressure P acts on the back side of the counterfort 16, the compressive force is exerted on the filler M and the connecting steel bars 20 in the steel bar insertion holes 22 at the front wall 14 side of the neutral plane N—N, while the tensile force is exerted on the filler M and the connecting steel bars 20 in the steel bar insertion holes 22 at the protruding side of the counterfort 16. Accordingly, the connecting steel bars 20 and the filler M in the steel bar insertion holes 22 exert a resistant force against the compressive force at the front wall side of the neutral plane N—N and a resistant force against the tensile force at the protruding end side of the neutral plane N—N.

Furthermore, since the steel bar insertion holes 22 disposed at the front wall 14 side from the neutral plane N—N are made of downwardly widened tapered holes 24, while the steel bar insertion holes 22 disposed at the protruding end side of the counterfort 16 displaced from the neutral plane N—N are made of upwardly widened tapered holes 26, when the soil pressure acts on the retaining wall structure 10, sliding movement of the filler M hardened in the steel bar insertion holes 22 relative to the steel bar insertion holes 22 is prevented thus enabling the construction of a retaining wall structure having high rigidity.

Figure 8:
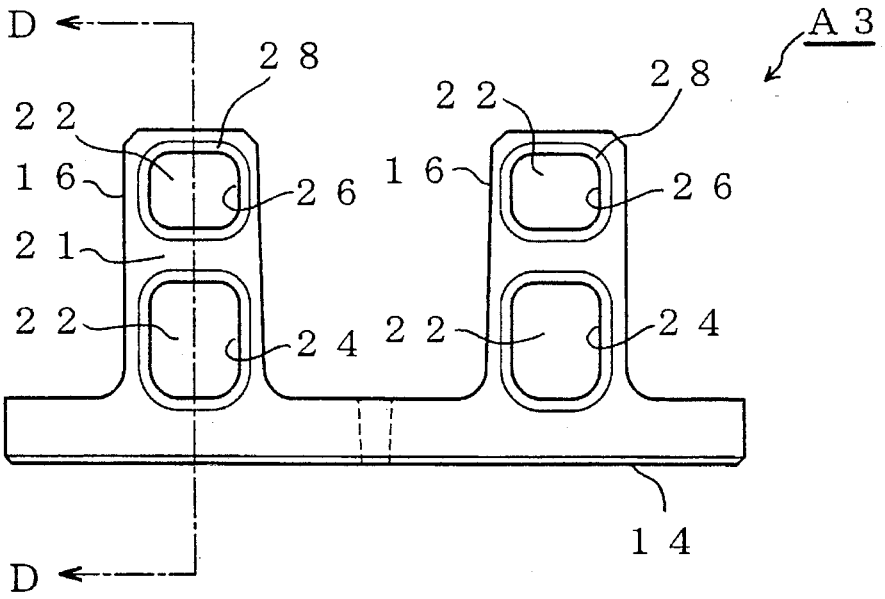
FIG. 8 is a plan view of a middle-sized block for constructing the retaining wall.
Figure 9:
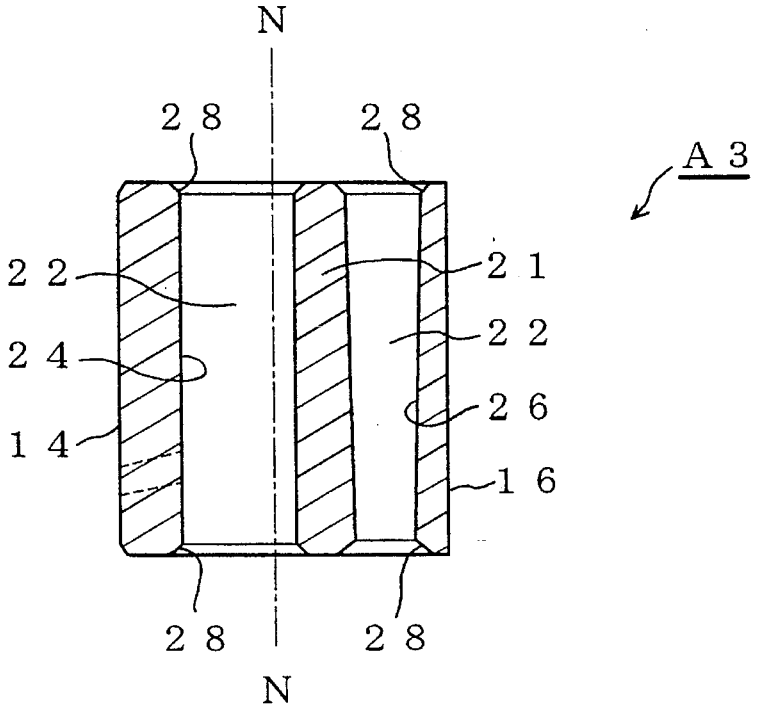
FIG. 9 is a cross sectional view of the middle-sized block for constructing the retaining wall taken along the line D—D of FIG. 8.

In FIG. 8 and FIG. 9, the middle-sized blocks A3 for constructing the upper layer of the constructed retaining wall structure 10 are shown. The middle-sized block A3 comprises the front wall 14 having the same shape as the front wall 14 of the above-mentioned secondary large-sized block A2 for constructing the retaining wall and a pair of counterforts 16,16 which protrude from the back surface of the front wall 14 at positions adjacent to both lateral ends of the front wall 14. Each counterfort 16 is provided with two steel bar insertion holes 22,22.

As shown in FIG. 9, among the steel bar insertion holes 22, one steel bar insertion hole 22, which is disposed close to the front wall 14 away from the neutral plane N—N of the block A for constructing the retaining wall, is formed having a downwardly widened tapered hole 24 with an increasing diameter from the upper end to the lower end, while the other hole 22 is formed as an upwardly widened tapered hole 26.

As shown in FIG. 14, two steel bar insertion holes 22 (A3), formed in the above-mentioned middle-sized blocks A3 for constructing the retaining wall, are arranged to be aligned with the steel bar insertion holes 22 (A2) formed in the front wall 14 side and the intermediate side of the counterfort 16. Furthermore, as shown in FIG. 9, the trumpet-shaped enlarged tapered faces 28,28 are formed in the upper and lower ends of the above-mentioned steel bar inserting holes 22.

Figure 10:
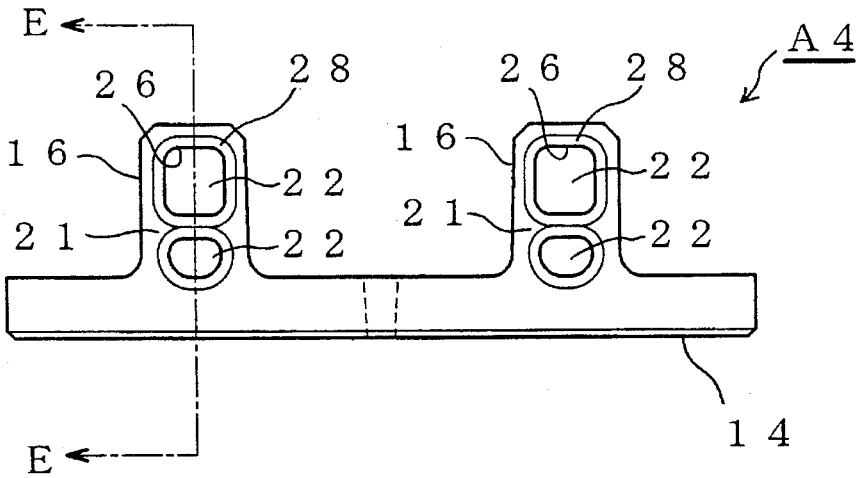
FIG. 10 is a plan view of a small-sized block for constructing the retaining wall.
Figure 11:
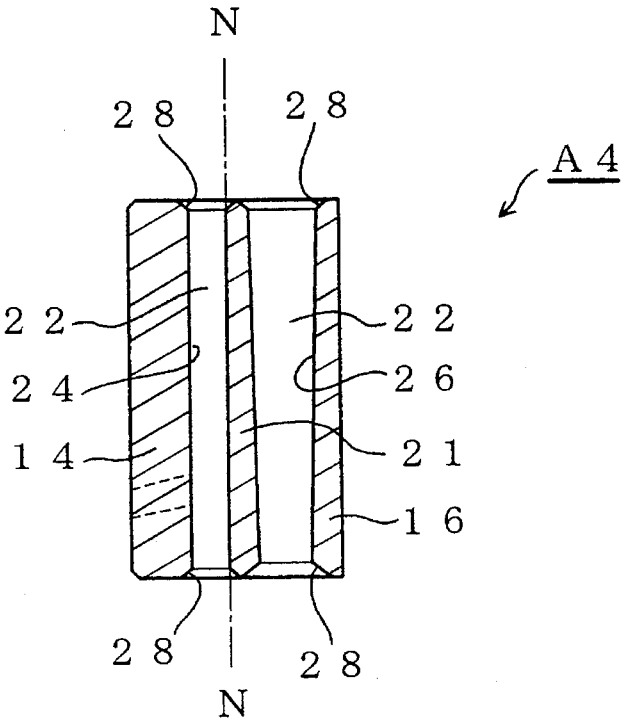
FIG. 11 is a cross sectional view of the small-sized block for constructing the retaining wall taken along the line E—E of FIG. 10.

In FIG. 10 and FIG. 11, the small-sized blocks A4 for constructing the uppermost layer of the constructed retaining wall structure 10 are shown.

The small-sized block A4 comprises the front wall 14 having the same shape as the front wall 14 of the above-mentioned middle-sized block A3 for constructing retaining wall and a pair of counterforts 16,16 which protrude from the back surface of the front wall 14 at positions adjacent to both lateral ends of the from wall 14 and have a length shorter than that of the middle-sized block A3 for constructing the retaining wall.

Each counterfort 16 is provided with two steel bar insertion holes 22,22.

As shown in FIG. 14, the two steel bar insertion holes 22 (A4) formed in the counterfort 16 of the above-mentioned small-sized block A4 for constructing retaining wall are provided such that they align with the steel bar insertion holes 22 (A3) formed in the counterfort 16 of the above-mentioned middle-sized block A3 which are disposed close to the from wall 14 side.

As shown in FIG. 11, among two steel bar insertion holes 22 of the above small-sized block A4 for constructing the retaining wall, one of the steel bar insertion holes 22, disposed at the front wall 14 side away from the neutral plane N—N, is formed as a downwardly widened taper-shaped hole 24 while the other steel bar insertion hole 22 is formed as an upwardly widened taper-shaped hole 26.

Furthermore, each steel bar insertion hole 22 is provided with trumpet-shaped enlarged tapered faces 28,28 at the upper and lower ends thereof.

The above-mentioned middle-sized blocks A3 for constructing the retaining wall are stacked on the upper surface of the above-mentioned secondary large-sized blocks A2 for constructing the retaining wall to construct the upper layer of the retaining wall structure 10, while the small-sized blocks A4 for constructing retaining wall are stacked on the upper surface of the middle-sized blocks A3 for constructing retaining wall. The connecting steel bars 20 are inserted in the steel bar insertion holes 22 which are vertically aligned and the filler M is filled and hardened to form the uppermost layer portion of the retaining wall structure 10.

As has been explained above, in the above-mentioned retaining wall structure 10, the blocks A comprising the large-sized blocks A1 for constructing the retaining wall, the secondary large-sized blocks A2 for constructing the retaining wall, the middle-sized blocks A3 for constructing the retaining wall and the small-sized blocks A4 for constructing the retaining wall are stacked in layers on the footing foundation 12 made of steel bar reinforced concrete, the anchoring steel bars 18 and the connecting steel bars 20, which are connected with anchoring steel bars 18, are inserted in the steel bar insertion holes 22 which are vertically aligned with each other, and the filler M, such as cement mortar or concrete, is filled in the aligned steel bar insertion holes 22.

Accordingly, in the above-mentioned retaining wall structure 10, for example, as shown in FIG. 17, at the front wall 14 side from the neutral plane N—N of the block A for constructing retaining wall, the filler M is filled and hardened in respective holes 24, each of which has the diameter becoming greater downwardly in a tapered manner to form a plurality of elongated frustconically shaped strum which are, in turn, integrally connected with each other to form the steel bar reinforced concrete pillar H1. The steel bar reinforced concrete pillar H1 is in turn integrally connected with the footing foundation 12 made of steel bar reinforced concrete.

Furthermore, at the protruding end portions of the counterforts 16 of blocks A for constructing retaining wall from the neutral plane N—N, the filler M is filled and hardened in respective holes 26, each of which has the diameter becoming greater upwardly in a tapered manner to form a plurality of inversely-frustoconically shaped struts which are, in turn, integrally connected with each other to form the steel bar reinforced pillar H2 which is integrally connected with the footing foundation 12 made of steel bar reinforced concrete.

When a large soil pressure acts on the rear sustaining side of the retaining wall structure 10, a bending stress is produced. Because of the bending stress, a compressive force is exerted downwardly on the front wall 14 side of the counterfort 16. However, the steel bar reinforced concrete pillar H1 which is formed by a plurality of elongated frustoconically shaped struts made of hardened filler M in the downwardly widened tapered holes withstands the compressive force and prevents sliding movement thereof relative to the tapered holes.

Furthermore, on the protruding end of the counterfort 16, an upward tensile force is exerted. However, the steel bar reinforced concrete pillar H2 which is formed by a plurality of elongated inversely-frustoconically shaped struts made of hardened filler M in the upwardly widened tapered holes 26 withstands the tensile force and prevents the slide movement thereof relative to the tapered holes. The steel bar reinforced concrete pillar H2 prevents sliding movement thereof relative to the steel bar insertion holes made of inversely tapered holes 26 and withstand the tensile strength.

Accordingly, the retaining wall structure 10 is a retaining wall structure having a sufficient rigidity.

In each block A for constructing the retaining wall, the steel bar insertion holes 22 at the from wall 14 side of the counterfort 16 are displaced from the neutral plane N—N of the bending stress and optionally made as a straight hole instead of the downwardly widened tapered hole 24.

In this case, in the steel bar insertion holes 22 which are vertically aligned with each other, a straight shaped pillar made of steel bar reinforced concrete is formed which can withstand the tensile force acting on the front wall 14 side.

Furthermore, on the abutting face of the vertically stacked blocks A for constructing the retaining wall, the trumpet-shaped faces 28,28 formed on the lower end of the steel bar insertion holes 22 of one block A for constructing the retaining wall are snugly merged with the trumpet-shaped faces 28,28 formed on the upper end of the steel bar insertion holes 22 of the adjacent block A for constructing the retaining wall and the filler M is hardened in a space formed by merged upper and lower trumpet-shaped faces 28,28 to form a peripheral protrusion 30 having a diamond-shaped cross section.

Due to such a construction, the steel bar reinforced pillars H1, H2, formed in the aligned steel bar insertion holes 22, prevent sliding movement thereof relative to the blocks A for constructing the retaining wall.

Furthermore, the amount of the filler M which is filled in the steel bar connecting portions within the steel insertion holes 22 is increased to provide a desired amount of covering on the anchoring steel bar 18 and the connecting steel bars 20 thus reinforcing the strength of the retaining wall structure.

In the above-mentioned retaining wall structure 10, the large-sized blocks A1 for constructing the retaining wall which have the longest counterfort 16 are mounted on the footing foundation 12 made of steel bar reinforce concrete, and the secondary large-sized blocks A2 for constructing the retaining wall, the middle-sized blocks A3 for constructing the retaining wall and the small-sized blocks A4 for constructing the retaining wall which sequentially shorten the length of the counterfort 16 are stacked thereon, wherein the counterforts 16 are stacked in a step-like manner.

In the counterforts 16, which are stacked in a step-like manner, the filler is filled and solidified in a plurality of steel bar insertion holes 22 which are vertically aligned and have an upwardly widened tapered inversely frustoconical hole to form a steel bar reinforced concrete pillar H2 which is integrally connected with the footing foundation 12 made of steel bar reinforced concrete, whereby the rigid body has a sufficient resistance against the soil pressure which increases in a secondary curve from the intermediate layer to the lower layer of the retaining wall structure so that the retaining wall structure having a height exceeding the maximum height of the conventional retaining wall structure can be constructed.

Figure 18:
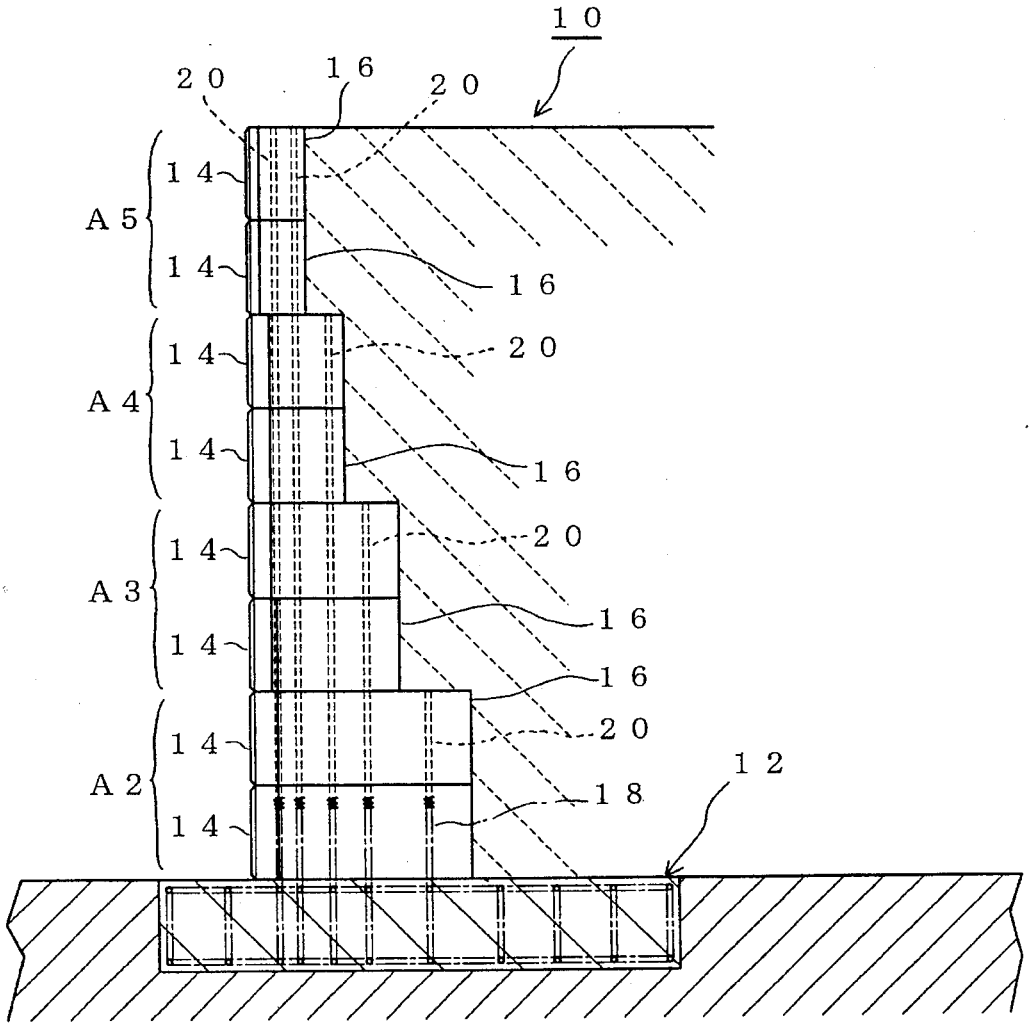
FIG. 18 is a longitudinal cross sectional view of the retaining wall structure of another embodiment.

In FIG. 18, the constructed retaining structure 10 of another embodiment is shown.

In the constructed retaining structure 10, a lower layer is formed on the footing foundation 12 made of steel bar reinforced concrete by stacking up the secondary large-sized blocks A2 for constructing the retaining wall, the intermediate layer is formed by stacking up the middle-sized blocks A3 for constructing the retaining wall and the small-sized blocks A4 for constructing the retaining wall, and an uppermost layer portion is formed by stacking up the small-sized blocks A5 for constructing the retaining wall.

Figure 12:
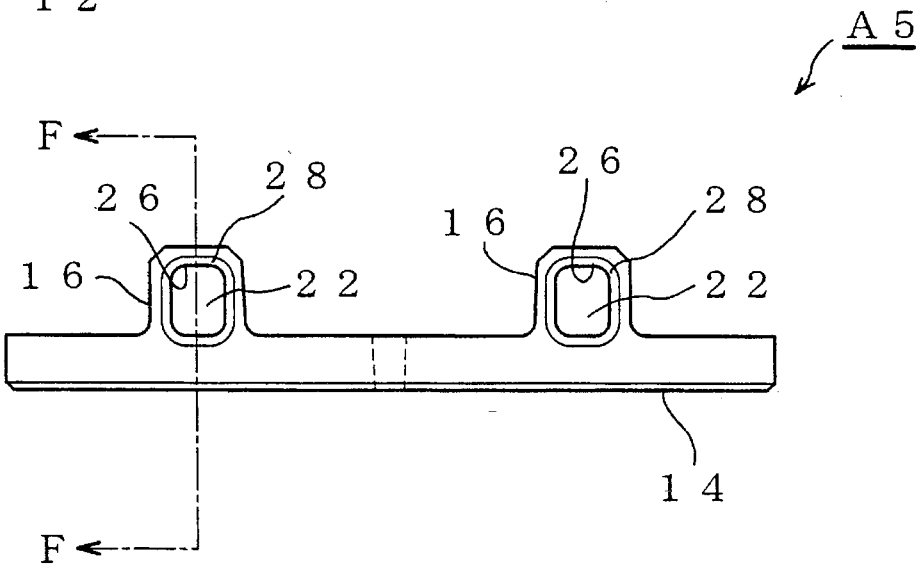
FIG. 12 is a plan view of another embodiment of the small sized block for constructing the retaining wall.
Figure 13:
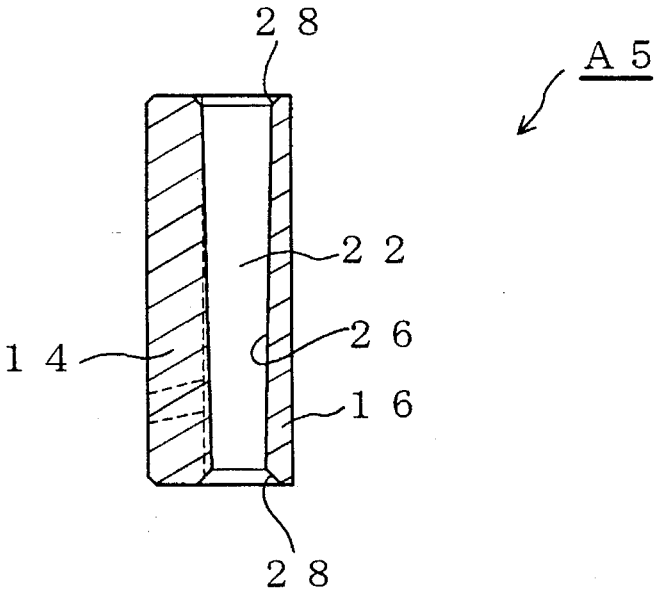
FIG. 13 is a cross sectional view of the small-sized block for constructing the retaining wall taken along the line F—F of FIG. 12.

The above-mentioned small-sized block A5 for constructing retaining wall is, as shown in FIG. 12 and FIG. 13, provided with a front wall 14 and a pair of counterforts 16,16 protruded from the back surface of the front wall 14.

The counterfort 16 of the small-sized blocks A5 for constructing retaining wall is provided with a single reinforced steel bar insertion hole 22 which communicates with the reinforced steel bar insertion hole 22 provided at the front wall 14 side of the counterfort 16 and is made as a straight hole having a uniform diameter throughout the length thereof instead of the upwardly widened tapered hole 26.

Furthermore, the steel bar insertion hole 22 is provided with trumpet-shaped widened tapered faces 28 at the upper and lower ends thereof.

Although the constructed retaining wall structure 10 is employed for constructing a low retaining wall structure, as in the case of the previous embodiment, the anchoring steel bars 18 and the connecting steel bars 20 are inserted in the steel bar insertion holes 22 which are vertically aligned and the filler is filled in the steel bar inserting holes 22 so as to construct the retaining wall structure having the section modulus.

Figure 19:
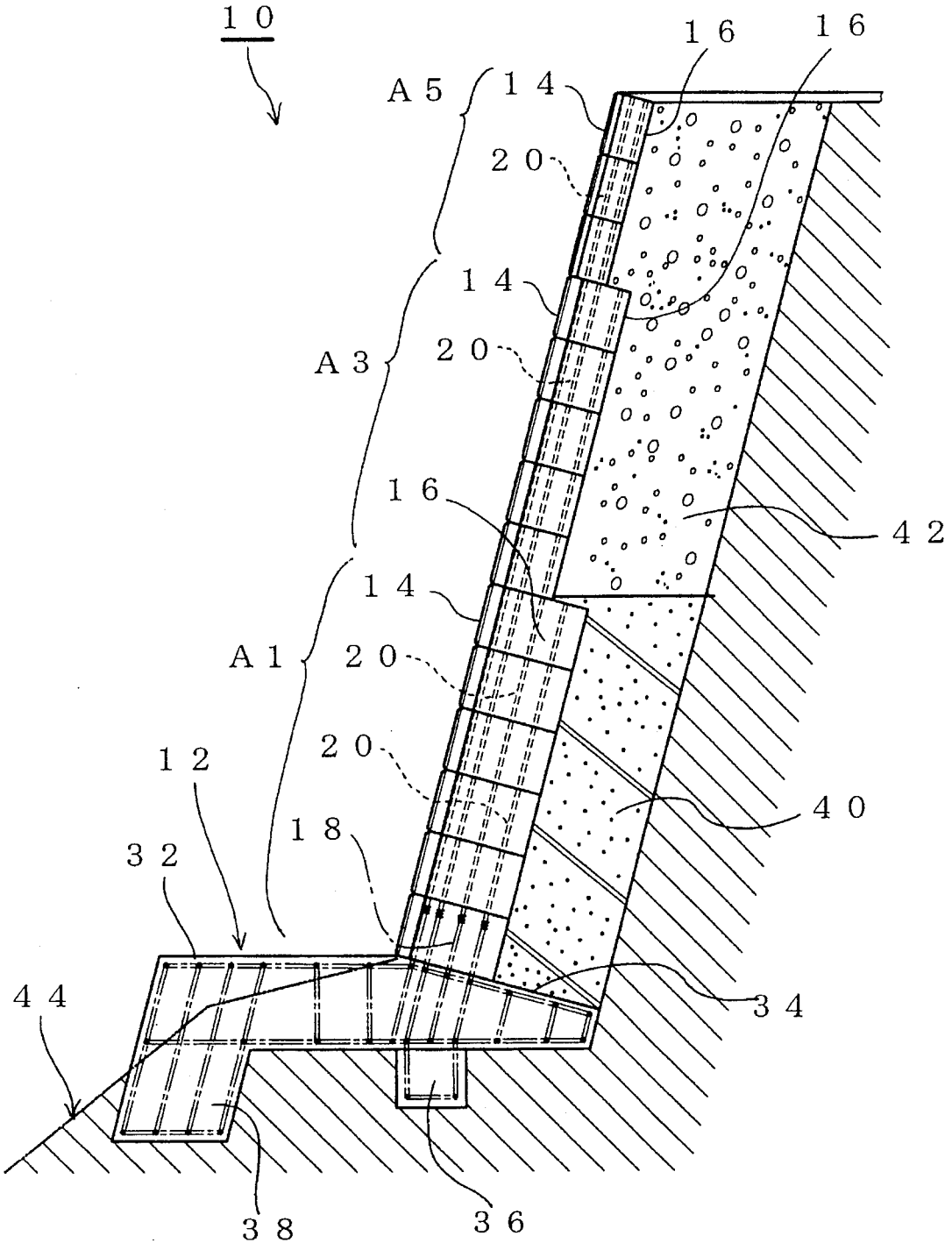
FIG. 19 is a longitudinal cross sectional view of the retaining wall structure of another embodiment.

In FIG. 19, the constructed retaining structure 10 of another embodiment is shown.

The footing foundation 12 is made of steel bar reinforced concrete and is provided with a front foot portion 32. A rear foot portion 34 is connected to a rear end of the front portion 32 and is provided with an inclined face inclined downwardly from a front end to a rear end thereof, and a slippage preventing protrusion 36 protrudes downwardly from a bottom of the foundation 12. The footing foundation 12 is also provided with a stepped down foundation 38 at the toe portion thereof.

With respect to the footing foundation 12 made of steel bar reinforced concrete, on the inclined surface of the rear foot portion 34, for example, from the lower layer, the above-mentioned large-sized block A1 for constructing the retaining wall, the intermediate blocks A3 for constructing the retaining wall and the small-sized blocks A5 are stacked on a slope gradient K of a cut slope of a construction site, with each block in a plurality of layers.

Then, as in the case of the previous embodiment, a plurality of anchoring steel bars protrude from the inclined surface of the rear foot portion 34 and a plurality of connecting steel bars, which are connected with the anchoring steel bars, are inserted into a plurality of steel bar insertion holes 22 vertically aligned with each other and then the filler is filled in the aligned steel bar insertion holes 22.

Simultaneously, in a space defined by the upper surface of the heel plate of the rear foot portion 34 and the back surface of the above-mentioned large-sized blocks A1 for constructing the retaining wall, a back-fill concrete 40 is filled and, subsequently, in a space defined by a back of the above-mentioned middle-sized blocks A3 for constructing retaining wall A3 and the small-sized blocks A5 for constructing retaining wall, back-fill materials 42 such as cobblestones, gravels and crasher runs are filled to construct the retaining wall 10. In the drawings, numeral 44 indicates a slope embankment.

In the constructed retaining structure 10 according to this embodiment, all the blocks A which are vertically stacked with each other are integrally connected with the footing foundation 12 made of steel bar reinforced concrete and a leaning force of the respective stacked block A for constructing retaining wall acts on the slope surface of the cut slope and resists the earth pressure. Because of this leaning force, a retaining wall having a height far higher than the height of the retaining wall which is vertically constructed is achievable.

In this embodiment, the width of the front and rear portions of the front foot portion 32 is made greater than the width of the front and rear portions of the rear foot portions 34. Due to such a construction, the footing foundation 12 made of steel bar reinforced concrete increases the rigidity in a transverse direction so that the footing foundation 12 can remarkably increase the resisting force, namely, the resisting moment against the turn down moment.

Furthermore, the above-mentioned footing foundation 12 made of steel bar reinforced concrete is provided with a protrusion 36 on the bottom surface thereof and a stepped down foundation 38 at the toe portion thereof. Accordingly, even at the site where the earth pressure is large, sliding movement of the footing foundation 12 made of steel bar reinforced concrete is prevented. Especially, the sliding movement preventing effect of the stepped down foundation 38 is remarkable.

At a construction site where the height of the retaining wall 10 is low and the earth pressure is small, it is unnecessary to provide the sliding movement preventing protrusion 36 on the bottom surface of the footing foundation 12, while it is also unnecessary to provide the back-fill concrete 40 in a space back of the large-sized blocks for constructing retaining wall. Instead, the back-fill material such as cobble stones, gravels and crusher runs are filled as the back-fill material in the space to save the construction cost.

As has been described heretofore, the blocks for constructing a retaining wall structure according to the present invention each comprise a from wall and a counterfort protruded from the back side of the front wall, and the counterfort is divided mainly by a plurality of partition walls to form a plurality of reinforcing steel bar insertion holes each of which has upper and lower ends thereof open-ended, and each reinforcing steel bar insertion hole which is disposed in a from wall side from a position assumed to be a neutral face of a bending stress caused by an outer force acting on the block m a direction toward the front wall side from the counterfort side is either a tapered hole increasing in diameter from the upper opening to the lower opening thereof or a straight hole having a uniform diameter throughout the entire length thereof, and each reinforcing steel bar insertion hole disposed in the rear end side from the neutral face is an inverse-tapered hole having a diameter increasing from the lower opening to the upper opening. The above-mentioned blocks for constructing the retaining wall are stacked on the upper surface of the footing foundation made of steel bar reinforced concrete, and the anchoring steel bars which protrude from the footing foundation and the connecting steel bars are inserted into the steel bar insertion holes which are vertically aligned with each other. The filler is filled in the steel bar insertion holes to construct the retaining wall. Due to such a construction, the hardened filler is prevented from sliding relative to the steel bar insertion hole and the rigidity of the junction where the abutting surfaces of the blocks for constructing retaining wall merge is increased to provide a rigid body integrally formed with the foundation. The retaining wall meets the various construction requirements including excellent section modulus so that the retaining wall has a height greater than the maximum height of the conventional retaining wall structure.

According to the present invention each reinforcing steel bar insertion hole formed in the counterfort may be provided with a trumpet-shaped tapered face at the upper and the lower ends thereof. Accordingly, when the blocks for constructing retaining wall are stacked to construct the retaining wall, the amount of filler filled in the junctions where steel bar insertion holes are merged is increased so that the anchoring steel bars and the connecting bars are covered with a proper amount of covering of filler thus reinforcing the strength of the constructed retaining wall structure while increasing the rigidity of the junctions where blocks are merged with each other.

Subsequently, in the constructed retaining wall structure according to the present invention the retaining wall structure comprises a plurality of blocks for constructing the retaining wall, and each block comprises a front wall and a counterfort protruded from the back side of the front wall. The counterfort is divided mainly by a plurality of partition walls to form a plurality of reinforcing steel bar insertion holes each of which has upper and lower ends thereof open-ended, and each reinforcing steel bar insertion hole which is disposed in a front wall side, away from a position assumed to be a neutral face of a bending stress caused by an outer force acting on the block in a direction toward the front wall side from the counterfort side, is either a tapered hole increasing diameter from the upper opening to the lower opening thereof or a straight hole having a uniform diameter throughout the entire length thereof. Each reinforcing steel bar insertion hole disposed in the rear end side from the neutral plane is an inverse-tapered hole having a diameter increasing from the lower opening to the upper opening. The blocks for constructing the retaining wall are stacked on the upper surface of a steel bar reinforced concrete-made footing foundation in such a manner that each reinforcing steel bar insertion hole is vertically aligned with the reinforcing steel bar insertion hole in the upper and lower layers, and a plurality of anchoring steel bars protruding from the footing foundation made of steel bar reinforced concrete and a plurality of connecting steel bars which are used for connecting blocks mounted on the footing foundation are connected in the reinforcing steel bar insertion holes and a filler is filled in the reinforcing steel bar inserting holes so as to integrally connect the blocks for constructing retaining wall with each other.

In the steel bar insertion holes at the front wall side away from the neutral plane, the filler is filled in the aligned downwardly widened tapered holes to form the steel bar reinforced concrete pillar which is merged with the footing foundation, while in the steel bar inserting holes at the counterfort side from the neutral plane, the filler is filled in the aligned upwardly widened tapered holes to form the steel bar reinforced concrete pillar which is merged with the footing foundation. Therefore, even when the earth pressure acts on the retaining wall structure from the counterfort side and the bending stress is exerted and due to this bending stress, the downward compressive force acts on the front wall side and the upward tensile force acts on the protruding end of the counterfort, the sliding movement of the steel bar reinforced concrete pillar relative to the block is prevented and the retaining structure withstands the compressive force and the tensile force to meet the requirements necessary for the rigid body and due to the elastic design method according to the elastic theory. The retaining structure has strong rigidity and is economically constructed.

Furthermore, according to the present invention, the blocks for constructing the retaining wall include a plurality of kinds of blocks which are different in the length of counterfort. The blocks for constructing the retaining wall having the greatest counterfort length are stacked on the upper surface of the steel bar reinforced concrete footing foundation and the blocks for constructing retaining wall having the shorter counterfort length are sequentially stacked to form the retaining wall structure which exhibits a stepped ladder shaped from a rear view. In the above-mentioned terrace-shaped retaining wall structure, the filler is filled in the upwardly widened steel bar reinforcing holes which are aligned with each other to build up the steel bar reinforced concrete pillar made of a plurality of steel bar reinforced inversely tapered concrete struts on the footing foundation. Thus, the retaining wall structure has a sufficient rigidity against the earth pressure which gradually increases from the upper layer to the lower layer enabling the construction of the retaining wall structure having a height exceeding several tens of meters.

Still furthermore, according to claim 5, the footing foundation made of steel bar reinforced concrete comprises a front foot portion, a rear foot portion which is connected to the rear end of the front portion and has a slope face inclined downwardly from the front portion to the rear portion and a slippage preventing protrusion formed on the bottom surface of the foundation. The front portion forms a stepped down foundation at a toe portion and the blocks for constructing the retaining wall are stacked on the slope face of rear foot portion in such a manner that the blocks for constructing retaining wall are stacked with an embankment gradient approximately similar to the slope gradient of a cut slope of the retaining wall construction site. Furthermore, on the heel portion of the rear foot portion, back-fill concrete is filled in the back side of the blocks for constructing the retaining wall so that the retaining wall which is integrally connected with the footing foundation made of steel bar reinforced concrete is constructed and such retaining wall has an excellent section modulus to provide the retaining wall structure having a height higher than the conventional retaining wall structure.

I claim:

1. A block, for constructing a retaining wall, comprising:

a front wall having a top and a bottom end and a counterfort protruding from a back side of the front wall and extending from said top to said bottom end of said front wall in a vertical direction;

the counterfort being formed of a plurality of partition walls defining a plurality of reinforcing steel bar insertion holes extending substantially vertically therein each having upper and lower ends thereof open-ended;

a neutral stress plane defined by a virtual plane in said block whereat stress due to a lateral stress applied to said back side of said block toward said front wall is neither tensile nor compressive;

each one of said reinforcing steel bar insertion holes disposed on a front wall side of said neutral stress plane having one of a tapered hole contour increasing in a diameter thereof from the upper end to the lower end thereof and a straight hole contour having a uniform diameter throughout; and each one of said reinforcing steel bar insertion holes disposed rearward of the neutral stress plane having an inverse-tapered hole contour increasing a diameter thereof from the lower end to the upper end.

2. A block according to claim 1, wherein at least one of said reinforcing steel bar insertion holes has a trumpet-shaped annular taper at the upper and the lower ends thereof.

3. A retaining wall structure comprising:

blocks, each having a front wall with a top and bottom end and a counterfort protruding from a back side of the front wall and extending from said top to said bottom end in a substantially vertical direction;

the counterfort being formed of a plurality of partition walls defining a plurality of reinforcing steel bar insertion holes extending substantially vertically therein, each having upper and lower ends thereof open-ended;

a neutral stress plane defined by a virtual plane in said block whereat stress due to a lateral stress applied to said back side of said block toward said front wall is neither tensile nor compressive;

each one of said reinforcing steel bar insertion holes disposed on a front wall side of said neutral stress plane having one of a tapered hole contour increasing in a diameter thereof from the upper end to the lower thereof and a straight hole contour having a uniform diameter throughout; and each one of said reinforcing steel bar insertion holes disposed rearward of the neutral stress plane having an inverse-tapered hole contour increasing in a diameter thereof from the lower end to the upper end;

the blocks are laid upon an upper surface of a footing foundation made of concrete reinforced by steel bars and stacked in such a manner that said reinforcing steel bar insertion holes vertically align and communicate with those thereunder;

a plurality of anchoring steel bars protruding from the footing foundation and a plurality of connecting steel bars connecting said blocks via the reinforcing steel bar insertion holes; and a filler filling the reinforcing steel bar insertion holes to integrally connect the blocks for constructing the retaining wall.

4. A retaining wall structure according to claim 3, wherein:

the blocks for constructing the retaining wall include plural kinds of blocks having varying lengths of counterforts;

one of said plural kinds of blocks has a greatest counterfort length of said plural kinds and are laid upon the upper surface of the footing foundation;

another one of said plural kinds of block having a next greatest counterfort length are laid upon upper surfaces of said blocks having the greatest counterfort length; and blocks of said plural kinds having a next shorter length are laid upon top surfaces of said block of said next greatest length and blocks of said plural kinds are sequentially laid upon each other in order of decreasing counterfort length until blocks having a shortest counterfort length form a top of said retaining wall structure and said retaining wall structure has a stepped contour.

5. A constructed retaining wall structure according to claim 4 wherein:

the footing foundation made of steel bar reinforced concrete comprises a front foot portion, a rear foot portion connected to a rear end of the front foot portion and having a slope face inclined downwardly from the front toot portion to the rear foot portion, and a slippage preventing protrusion formed on a bottom surface of the footing foundation;

the front portion has a stepped-down foundation at a toe portion;

the blocks for constructing the retaining wall are stacked on the slope face of the rear toot portion with an embankment gradient which is similar to a slope gradient of a cut slope at a construction site for the retaining wall; and back-filling concrete is filled in at a backside of the blocks for constructing the retaining wall stacked in the above manner from an upper portion of a heel plate of the rear foot portion.

6. A constructed retaining wall structure according to claim 3 wherein:

the footing foundation made of steel bar reinforced concrete comprises a front foot portion, a rear foot portion connected to a rear end of the front foot portion and having a slope face inclined downwardly from the front foot portion to the rear foot portion and a slippage preventing protrusion formed on a bottom surface of the footing foundation;

the front portion has a stepped-down foundation at a toe portion;

the blocks for constructing the retaining wall are stacked on the slope face of the rear foot portion with an embankment gradient which is similar to a slope gradient of a cut slope at a construction site for the retaining wall; and back-filling concrete is filled in at a backside of the blocks for constructing the retaining wall stacked in the above manner from an upper portion of a heel plate of the rear toot portion.

* * * * *